US010403418B2

(12) United States Patent
Aoyagi et al.

(10) Patent No.: US 10,403,418 B2
(45) Date of Patent: Sep. 3, 2019

(54) MULTICORE CABLE AND METHOD FOR MANUFACTURING MULTICORE CABLE

(71) Applicant: TATSUTA ELECTRIC WIRE & CABLE CO., LTD., Osaka (JP)

(72) Inventors: Yoshihiko Aoyagi, Kyoto (JP); Yoshinori Kawakami, Osaka (JP); Kiyotaka Urashita, Kyoto (JP)

(73) Assignee: TATSUTA ELECTRIC WIRE & CABLE CO., LTD., Osaka (JP)

( * ) Notice: Subject to any disclaimer, the term of this patent is extended or adjusted under 35 U.S.C. 154(b) by 0 days.

(21) Appl. No.: 16/089,192

(22) PCT Filed: Feb. 21, 2017

(86) PCT No.: PCT/JP2017/006280

§ 371 (c)(1),
(2) Date: Sep. 27, 2018

(87) PCT Pub. No.: WO2017/169294

PCT Pub. Date: Oct. 5, 2017

(65) Prior Publication Data

US 2019/0115124 A1 Apr. 18, 2019

(30) Foreign Application Priority Data

Mar. 30, 2016 (JP) ..... 2016-069049

(51) Int. Cl.
*H01R 9/05* (2006.01)
*H01B 11/20* (2006.01)
(Continued)

(52) U.S. Cl.
CPC ..... *H01B 11/203* (2013.01); *H01B 3/427* (2013.01); *H01B 3/441* (2013.01); *H01B 7/00* (2013.01);
(Continued)

(58) Field of Classification Search
CPC ... H01B 7/02; H01B 7/04; H01B 7/06; H01R 9/05
(Continued)

(56) References Cited

U.S. PATENT DOCUMENTS 5,241,135 A * 8/1993 Fetzer ..... H01R 9/0512 174/88 R
5,281,762 A * 1/1994 Long ..... H01R 9/0515 174/117 F
(Continued)

FOREIGN PATENT DOCUMENTS

| | | |
|---|---|---|
| JP | 2007-280772 | 10/2007 |
| JP | 2015-138752 | 7/2015 |
| WO | 2009/014010 | 1/2009 |

OTHER PUBLICATIONS

International Search Report dated Mar. 21, 2017 filed in PCT/JP2017/006280.

*Primary Examiner* — William H. Mayo, III
(74) *Attorney, Agent, or Firm* — Rankin, Hill & Clark LLP

(57) ABSTRACT

Cost reduction in a multicore cable is realized by reduction in the frequency of damaging a coaxial cable upon removal of a covering layer. A multicore cable 10 includes multiple coaxial cables 11 arranged in parallel, and ground members 15, 16 conductively connected with the coaxial cables 11. Each coaxial cable includes an internal conductor 11*a*, an internal insulating layer 11*b* covering an outer peripheral surface of the internal conductor 11*a*, an external conductor 11*c* covering an outer peripheral surface of the internal insulating layer 11*b*, a covering layer 11*d* covering an outer peripheral surface of the external conductor 11*c*, a removed portion 11*e* formed in such a manner that part of the covering layer 11*d* in a circumferential direction is removed such that the external conductor 11*c* is exposed, and a
(Continued)

conductive member 21 filling the removed portion 11*e*. The ground member 15 is conductively connected with the conductive member 21 filling the removed portion 11*e*.

9 Claims, 18 Drawing Sheets

(51) Int. Cl.
*H01B 7/00* (2006.01)
*H01B 13/00* (2006.01)
*H01B 3/42* (2006.01)
*H01B 3/44* (2006.01)
*H01B 13/016* (2006.01)

(52) U.S. Cl.
CPC ..... *H01B 11/20* (2013.01); *H01B 13/00* (2013.01); *H01B 13/016* (2013.01); *H01R 9/05* (2013.01)

(58) Field of Classification Search
USPC ..... 174/102 R, 108, 109, 110 R, 113 R, 28
See application file for complete search history.

(56) References Cited

U.S. PATENT DOCUMENTS 6,734,374 B2 * 5/2004 Tang ..... H01R 9/0515 174/250
7,696,436 B2 * 4/2010 Tanaka ..... H01R 12/592 174/74 R
2001/0011600 A1 * 8/2001 Daume ..... H01R 4/646 174/78
2001/0022234 A1 * 9/2001 Okumura ..... H01R 9/0512 174/78
2002/0153157 A1 * 10/2002 Harger ..... H01R 4/646 174/78
2005/0039941 A1 * 2/2005 Marroquin ..... H01R 4/646 174/78
2014/0338951 A1 * 11/2014 Sunaga ..... H01R 9/032 174/78

* cited by examiner

MULTICORE CABLE AND METHOD FOR MANUFACTURING MULTICORE CABLE

TECHNICAL FIELD

The present invention relates to a multicore cable having multiple coaxial cables arranged in parallel and a method for manufacturing the multicore cable.

BACKGROUND ART

With popularization of electronic equipment such as a laptop computer, a mobile phone, and a small-sized video camera, size reduction and weight reduction in these types of electronic equipment have been demanded. In addition, a higher speed and higher image quality have been also demanded. Conventionally, an extremely-thin coaxial cable has been used for, e.g., connection between an equipment body and a liquid crystal display unit and wiring in equipment. Because of easy wiring, a harness-shaped multicore cable including multiple assembled and integrated coaxial cables has been used (e.g., Patent Literature 1).

CITATION LIST

Patent Literature

PATENT LITERATURE 1: JP-A-2007-280772

SUMMARY OF THE INVENTION

Problems to be Solved by the Invention

For the electronic equipment, cost reduction has been demanded in addition to size reduction, weight reduction, the higher speed, and the higher image quality. Thus, cost reduction has been also demanded for a multicore cable mounted on the electronic equipment.

An object of the present invention is to provide a multicore cable configured so that cost reduction can be realized and a method for manufacturing the multicore cable.

Solution to the Problems

A multicore cable according to the present invention includes: multiple coaxial cables arranged in parallel; and a ground member conductively connected with the coaxial cables. Each coaxial cable includes an internal conductor, an internal insulating layer covering an outer peripheral surface of the internal conductor, an external conductor covering an outer peripheral surface of the internal insulating layer, a covering layer covering an outer peripheral surface of the external conductor, a removed portion formed in such a manner that part of the covering layer in a circumferential direction is removed such that the external conductor is exposed, and a conductive member filling the removed portion, and the ground member is conductively connected with the conductive member filling the removed portion.

According to the above-described configuration, part of the covering layer is removed, and therefore, the frequency of damaging the coaxial cable upon removal of the covering layer is more reduced as compared to the case of removing the entire circumference of the covering layer. Thus, a yield rate is improved. Consequently, cost reduction in the multicore cable can be realized.

The removed portion in the present invention may be formed in a hole shape.

According to the above-described configuration, the removed portion can be, with high accuracy, easily formed at a desired position by punching with a drill or a laser beam.

The removed portion in the present invention may be formed in a truncated pyramid shape having the maximum diameter on an outer peripheral side of the covering layer.

According to the above-described configuration, the process of filling the removed portion with the conductive member is facilitated.

In at least one of the coaxial cables in the present invention, the internal conductor may be further exposed through the removed portion.

According to the above-described configuration, the internal conductor and the external conductor are exposed through the removed portion. Thus, the internal conductor and the external conductor are in electric conduction with each other through the conductive member filling the removed portion. Consequently, the multicore cable can be formed using the same coaxial cable. In addition, in at least one of the coaxial cables, the total of the cross-sectional area of the internal conductor and the cross-sectional area of the external conductor can be a current flow path cross-sectional area. Thus, the multicore cable of the present invention can be used as a ground short circuit cable exhibiting reduced electric resistance.

The ground member and the conductive member in the present invention may be formed from conductive paste.

According to the above-described configuration, the process of connecting the ground member with the external conductor can be completed by one step as compared to the case of using a plate-shaped ground bar as the ground member. That is, filling the removed portion with the conductive member and connection of the ground member with the coaxial cable can be completed using the conductive paste by one step. Thus, excellent workability is exhibited.

In the present invention, the internal insulating layer in each coaxial cable may contain modified polyphenylene ether or a resin mixture of cycloolefin resin and styrene-butadiene copolymer.

The modified polyphenylene ether is easily evaporated by an excimer laser beam. Thus, according to the above-described configuration, the removed portion can be easily formed by excimer laser processing.

A method for manufacturing a multicore cable according to an embodiment of the present invention is a method for manufacturing a multicore cable that includes multiple coaxial cables arranged in parallel and a ground member conductively connected with the coaxial cables. The method includes: forming a removed portion in such a manner that part of a covering layer of each coaxial cable including an internal conductor, an internal insulating layer covering an outer peripheral surface of the internal conductor, an external conductor covering an outer peripheral surface of the internal insulating layer, and the covering layer covering an outer peripheral surface of the external conductor is removed in a circumferential direction such that the external conductor is exposed, and subsequently filling the removed portion with a conductive member; and conductively connecting the ground member with the conductive member filling the removed portion in a state in which the coaxial cables are arranged in parallel.

According to the above-described configuration, part of the covering layer is removed, and therefore, the frequency of damaging the coaxial cable upon removal of the covering layer is more reduced as compared to the conventional case of removing the entire circumference of the covering layer.

Thus, the yield rate is improved. Consequently, cost reduction in the multicore cable can be realized.

The removed portion in the present invention may be formed by a laser beam.

According to the above-described configuration, the removed portion can be easily formed.

A method for manufacturing a multicore cable according to another embodiment of the present invention is a method for manufacturing a multicore cable that includes multiple coaxial cables arranged in parallel and a ground member conductively connected with the coaxial cables. The method includes: forming a removed portion in such a manner that part of a covering layer of each coaxial cable including an internal conductor, an internal insulating layer covering an outer peripheral surface of the internal conductor, an external conductor covering an outer peripheral surface of the internal insulating layer, and the covering layer covering an outer peripheral surface of the external conductor is removed in a circumferential direction such that the external conductor is exposed, and subsequently filling the removed portion with conductive paste to form a conductive member in a state in which the coaxial cables are arranged in parallel while forming the ground member from the conductive paste.

According to the above-described configuration, the removed portion of the covering layer is used as a mark so that determination of the axial positions of the coaxial cables arranged in parallel can be easily performed with high accuracy. Further, the removed portions of the coaxial cables arranged in parallel are filled with the conductive paste. Thus, a conductive member is formed. In addition, a ground member is also formed. With this configuration, the process of connecting the ground member with the external conductor can be completed by one step as compared to the case of using a plate-shaped ground bar as the ground member. That is, filling the removed portion with the conductive member and connection of the ground member with the coaxial cable can be completed using the conductive paste by one step. Thus, the multicore cable manufacturing method of the present invention exhibits excellent workability.

Effects of the Invention

According to the present invention, the frequency of damaging the coaxial cable upon removal of the covering layer is reduced. Thus, the yield rate is improved. Consequently, cost reduction in the multicore cable can be realized.

DESCRIPTION OF THE EMBODIMENTS

Hereinafter, a preferable embodiment of the present invention will be described with reference to the drawings.

(Multicore Cable 10)

Figure 1:
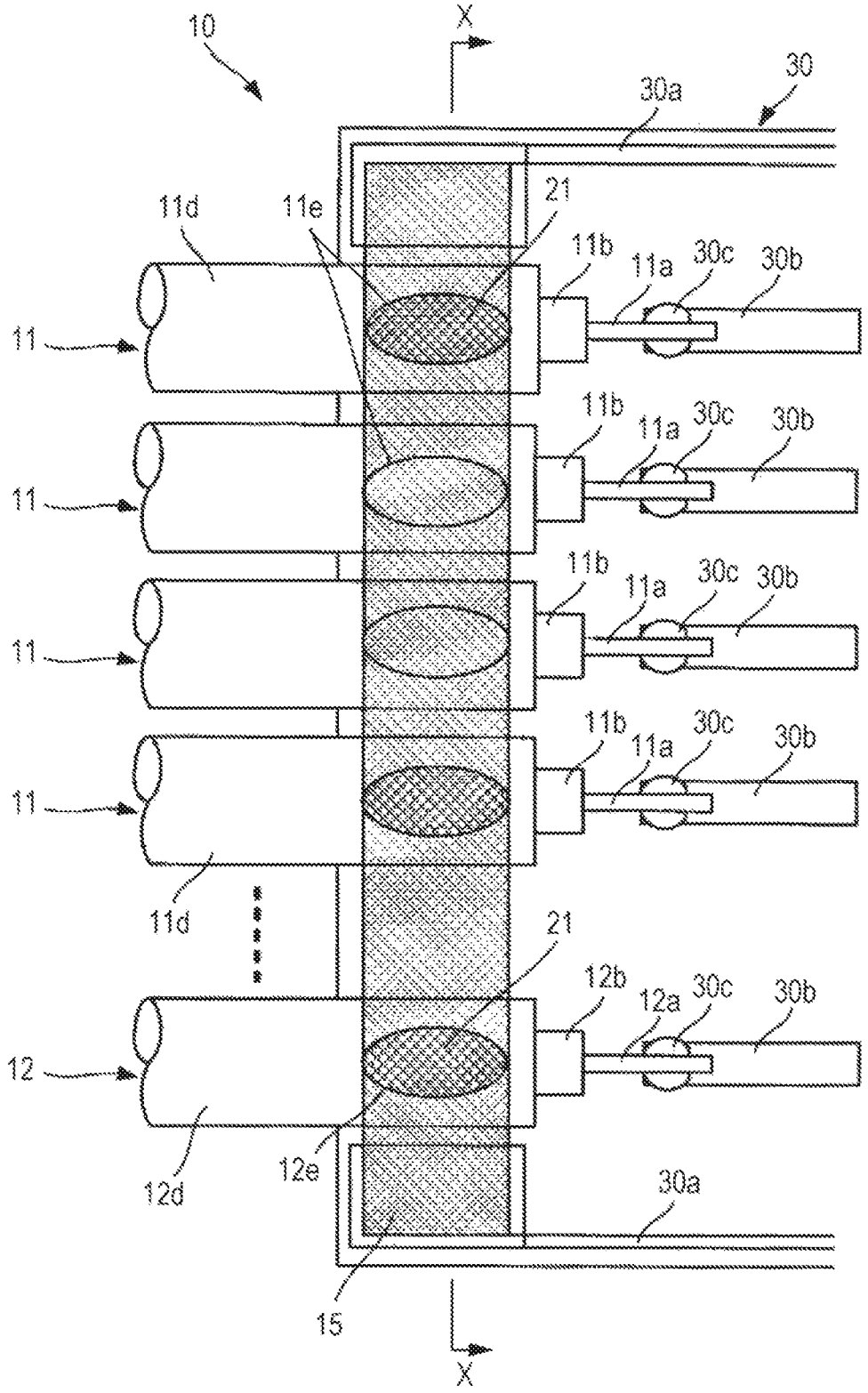
FIG. 1 is a plan view of a multicore cable.
Figure 2:
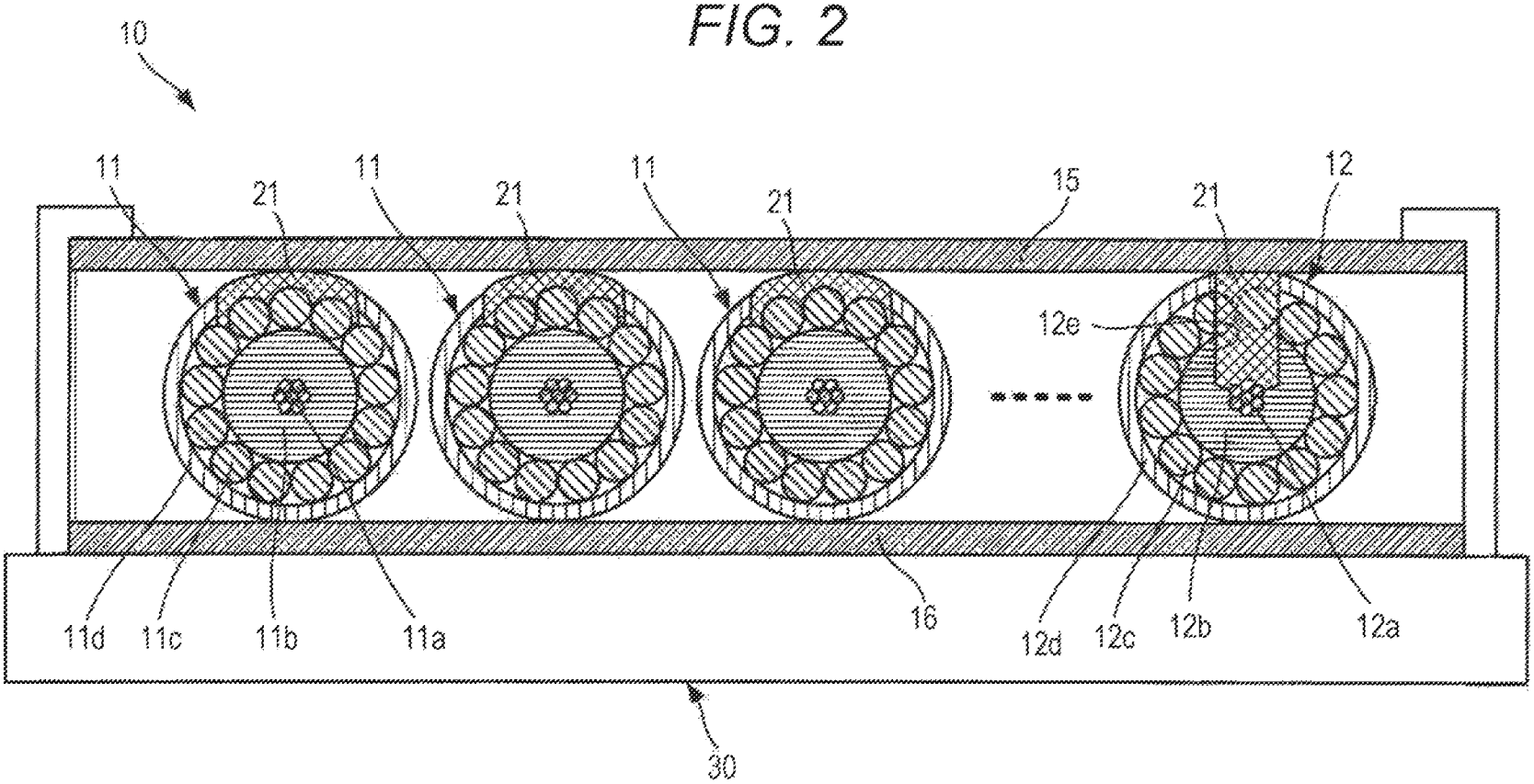
FIG. 2 is a longitudinal sectional view of the multicore cable along an X-X line of FIG. 1.

As illustrated in FIG. 1, a multicore cable 10 includes multiple coaxial cables 11 arranged in parallel, and ground members 15, 16 conductively connected to these coaxial cables 11. That is, as illustrated in FIG. 2, the multicore cable 10 has a configuration with an assembly of the coaxial cables 11 arranged in parallel and position-adjusted in an axial direction. In this configuration, the assembly of the coaxial cables 11 is sandwiched between two ground members 15, 16 in an upper-to-lower direction at a position separated from a tip end in the axial direction by a predetermined distance.

The multicore cable 10 has internal conductors 11*a* of the coaxial cables 11 bent as necessary. Each internal conductor 11*a* is, at a soldering portion 30*c*, soldered to a corresponding one of multiple connection target portions 30*b* provided at a connection target member 30. Note that in a case where the connection target member 30 is not a substrate but a connector, i.e., a case where the multicore cable 10 is a connector-equipped multicore cable, a metal plate shell having a backwards C-shaped cross-section is soldered onto the ground member 15 on one side to cover the ground member 15. The shell is soldered onto the ground member 15 in such a manner that solder is injected through a solder injection hole arranged at an upper surface of the shell. Moreover, both tip ends of the shell are connected to a connection target portion of the connector for grounding. Thus, the ground member 15 is grounded.

Note that the multicore cable 10 may employ various forms such as a form in which a connector is provided at each end portion and a form in which a connector is provided at one end portion and a substrate is connected at the other end portion.

The coaxial cable 11 has the internal conductor 11*a*, an internal insulating layer 11*b* covering an outer peripheral surface of the internal conductor 11*a*, an external conductor 11*c* covering an outer peripheral surface of the internal insulating layer 11*b*, a covering layer 11*d* covering an outer peripheral surface of the external conductor 11*c*, a removed portion 11*e* formed in such a manner that part of the covering layer 11*d* in a circumferential direction is removed such that the external conductor 11*c* is exposed, and a conductive member 21 filling the removed portion 11*e*. The ground member 15 is conductively connected to the conductive member 21 filling the removed portion 11*e*.

In the multicore cable 10 configured as described above, the removed portion 11*e* of the coaxial cable 11 is formed by removal of part of the covering layer 11*d*. Thus, cost reduction can be realized. A reason for realizing cost reduction will be described in detail below. In the case of removing part of the covering layer 11*d*, external force on the coaxial cable 11 is more reduced as compared to the case of removing the entire circumference of the covering layer 11*d*. Moreover, a removal amount is reduced. Thus, resistive force against the external force increases. Consequently, the probability of damaging the coaxial cable 11 in a process in which the external force is on the coaxial cable 11, such as the process of removing the covering layer 11*d* or a terminal process after removal, is reduced. As a result, the yield rate of the coaxial cable 11 is improved. Thus, cost reduction in the multicore cable 10 can be realized.

Further, the multicore cable 10 configured as described above uses, as a mark, the removed portions 11*e* or the conductive members 21 filling the removed portions 11*e* so that the conductive members 21 of the coaxial cables arranged in parallel can contact the ground members 15, 16 and can be conductively connected with the ground members 15, 16. In this manner, a positional relationship in the axial direction of the coaxial cable 11 among the ground members 15, 16 and the coaxial cables 11 can be determined with high accuracy. Moreover, the multicore cable 10 uses, as a mark, the removed portions 11*e* or the conductive members 21 filling the removed portions 11*e* so that the coaxial cables 11 can be arranged in parallel. In addition, the conductive members 21 of these coaxial cables can contact the ground members 15, 16, and can be conductively connected with the ground members 15, 16. Note that in the present embodiment, a case where the conductive members 21 of the coaxial cables arranged in parallel can contact the ground members 15, 16 will be described. Note that the present embodiment is not limited to this case.

(Multicore Cable 10: Coaxial Cable 11)

As described above, the coaxial cable 11 is formed in such a manner that the internal conductor 11*a*, the internal insulating layer 11*b*, the external conductor 11*c*, and the covering layer 11*d* are coaxially arranged from an inner peripheral side to an outer peripheral side. A process of removing a portion of the internal insulating layer 11*b* to expose the internal conductor 11*a* by a length sufficient for the connection is performed on an end portion of the coaxial cable 11. In this manner, the coaxial cable 11 is configured such that the internal conductor 11*a* and the internal insulating layer 11*b* are, in this order from a tip end side, exposed in a stepwise manner by predetermined lengths.

For example, the internal conductor 11*a* is formed from twisted seven copper alloy wires. The internal insulating layer 11*b* is formed in such a manner that an outer surface of the internal conductor 11*a* is covered by an insulating material such as Teflon (registered trademark) resin as fluorine resin. Preferably, "modified polyphenylene ether resin" or a "resin mixture of cycloolefin resin and styrene-butadiene copolymer" is used for the internal insulating layer 11*b*. This is because these resins are easily evaporated by an excimer laser beam, and therefore, the removed portion 11*e* can be easily formed by excimer laser processing. Details will be described later.

For example, the external conductor 11*c* is formed from a copper alloy wire horizontally wound in a spiral manner. For example, the covering layer 11*d* can be formed in such a manner that two polyester tapes lap-wound around an outer surface of the external conductor 11*c* are fused to each other. Note that the internal conductor 11*a* may be formed from a copper wire. The internal insulating layer 11*b* may be, in addition to the fluorine resin, made of a resin mixture of polyvinyl chloride (PVC), modified polyphenylene ether (m-PPE), or cycloolefin resin (COP) and styrene-butadiene copolymer. The external conductor 11*c* and the covering layer 11*d* can be formed in such a manner that a copper-deposited PET tape is wound around the outer peripheral surface of the internal insulating layer 11*b* with a copper-deposited surface facing inside. Alternatively, the external conductor 11*c* may be formed from two layers wound in a direction opposite to a winding direction of the copper alloy wires of the internal conductor 11*a*. As another alternative, the external conductor 11*c* may be formed to have other structures. The external conductor 11*c* may be formed from conductive paste such as Ag paste. The covering layer 11*d* can be made of fluorine resin, urethane resin, or polycarbonate resin.

One example of the coaxial cable 11 will be specifically described. A cable corresponding to AWG42 of American Wire Gage (AWG) standards is used as the coaxial cable 11. The outer diameter of the AWG42 coaxial cable 11 is set to 0.31 mm. For example, the internal conductor 11*a* is formed in such a manner that seven tin-plated copper alloy wires having an outer diameter of 0.025 mm are twisted. The internal insulating layer 11*b* is formed in such a manner that the outer peripheral surface of the internal conductor 11*a* is covered by fluorine resin such as perfluoroalkoxy fluorine resin (PFA). The outer diameter of the internal insulating layer 11*b* is set to 0.17 mm. The external conductor 11*c* is formed in such a manner that a tin-plated copper alloy wire having an outer diameter of 0.03 mm is spirally wound around the outer peripheral surface of the internal insulating layer 11*b*. The outer diameter of the external conductor 11*c* is set to 0.23 mm. The covering layer 11*d* is formed in such a manner that the outer peripheral surface of the external conductor 11*c* is covered by fluorine resin such as PFA.

(Multicore Cable 10: Coaxial Cable 11: Removed Portion 11*e*)

In the removed portion 11*e*, the outer peripheral surface of the external conductor 11*c* is exposed in such a manner that part of the covering layer 11*d* in the circumferential direction is removed. "Removal of the covering layer 11*d*" as described herein may be performed by any processing method. For example, a laser beam and a drill may be used. "Exposure of the external conductor 11*c*" as described herein means that at least one of the outer peripheral surface of the external conductor 11*c* as an outer peripheral surface in a radial direction, an inner peripheral surface of the external conductor 11 c as an inner peripheral surface in the radial direction, and an end surface of the external conductor 11*c* as a cut surface is exposed. "Exposure" means that an outer peripheral structure such as the covering layer 11*d* is removed from an inner peripheral structure, such as the external conductor 11*c*, covered by the outer peripheral structure so that filling with a filler such as the conductive member 21 from an external space is possible.

As illustrated in FIG. 1, each removed portion 11*e* is formed to have the oval outer shape formed by removal of the covering layer 11*d*. A major axis direction of the oval removed portion 11*e* is coincident with the axial direction of the coaxial cable 11. Moreover, a major axis is coincident with the width of the ground member 15. Further, the removed portion 11*e* is coincident with the position of the ground member 15 determined in the axial direction of the coaxial cable 11. With this configuration, all of the removed portions 11*e* are arranged in line in an array direction of the coaxial cables 11. Thus, both ends of the ground member 15 in a width direction thereof are adjusted to both end portions of each removed portion 11*e* in the major axis direction, and therefore, determination of the position of the ground member 15 in the axial direction of the coaxial cable 11 can be easily performed with high accuracy.

Note that the removed portion 11*e* may be in a hole shape having a peripheral edge portion surrounded by the covering layer. That is, the hole shape of the removed portion 11*e* is not limited to the oval shape. The hole shape may be a circular shape, a triangular shape, a rectangular shape, or a polygonal shape.

(Multicore Cable 10: Coaxial Cable 11: Variations of Removed Portion 11*e*)

Figure 3:
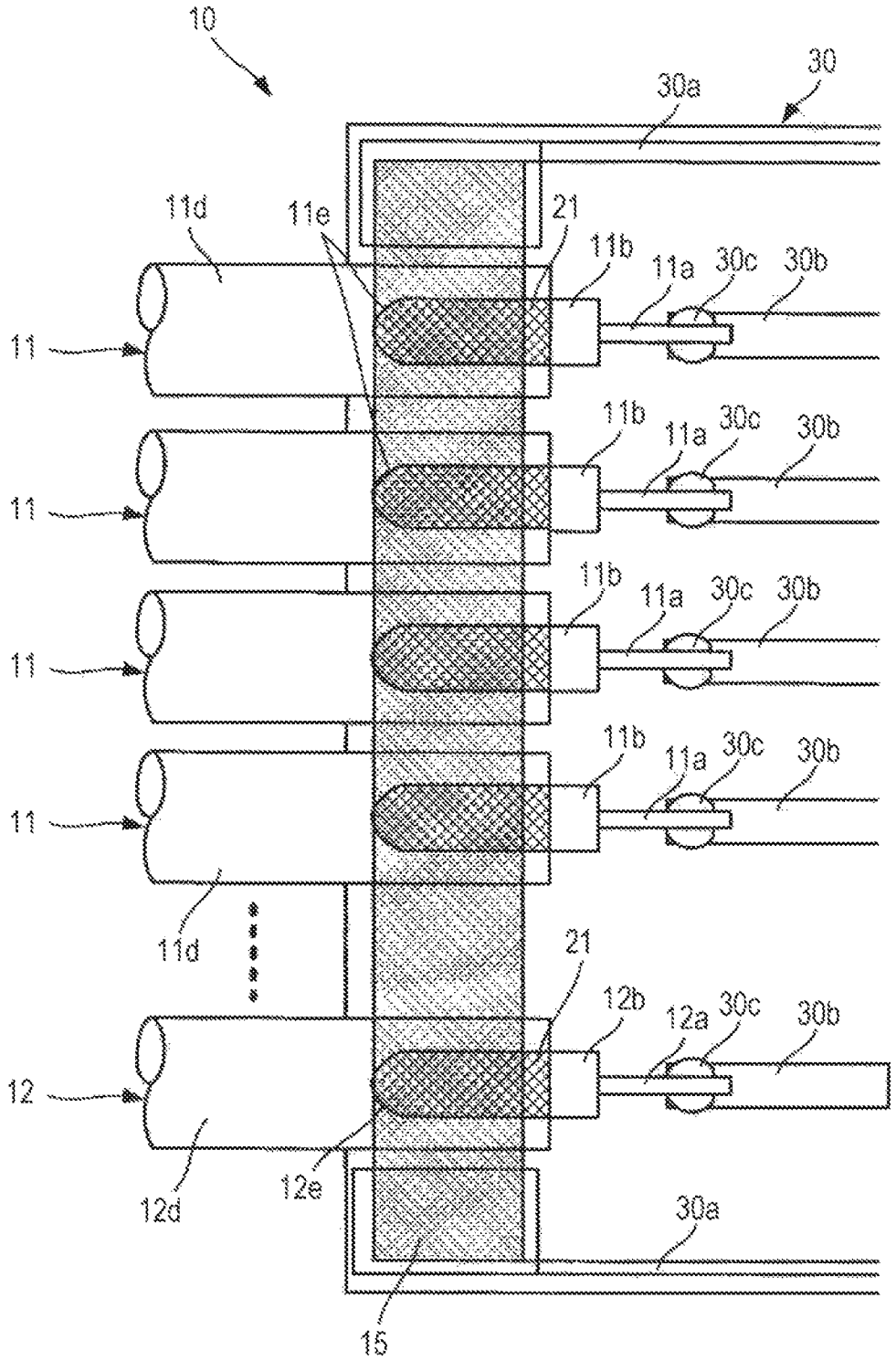
FIG. 3 is a plan view of a multicore cable.

In the present embodiment, a case where the removed portion 11*e* is formed in the hole shape has been described. Note that the present embodiment is not limited to this case. Specifically, as illustrated in FIG. 3, the shape of the removed portion 11*e* may be a cutout shape of which peripheral edge portion partially reaches an end surface of the covering layer 11*d*. Preferably, the end portions of the cutout-shaped removed portions 11*e* and the ground member 15 in the axial direction of the coaxial cable 11 are coincident with each other. In this case, all of the removed portions 11*e* are arranged in line in the array direction of the coaxial cables 11. Thus, one end of the ground member 15 in the width direction is adjusted to the end portions of the removed portions 11*e*, and in this manner, determination of the position of the ground member 15 in the axial direction of the coaxial cable 11 can be easily performed with high accuracy.

Figure 4:
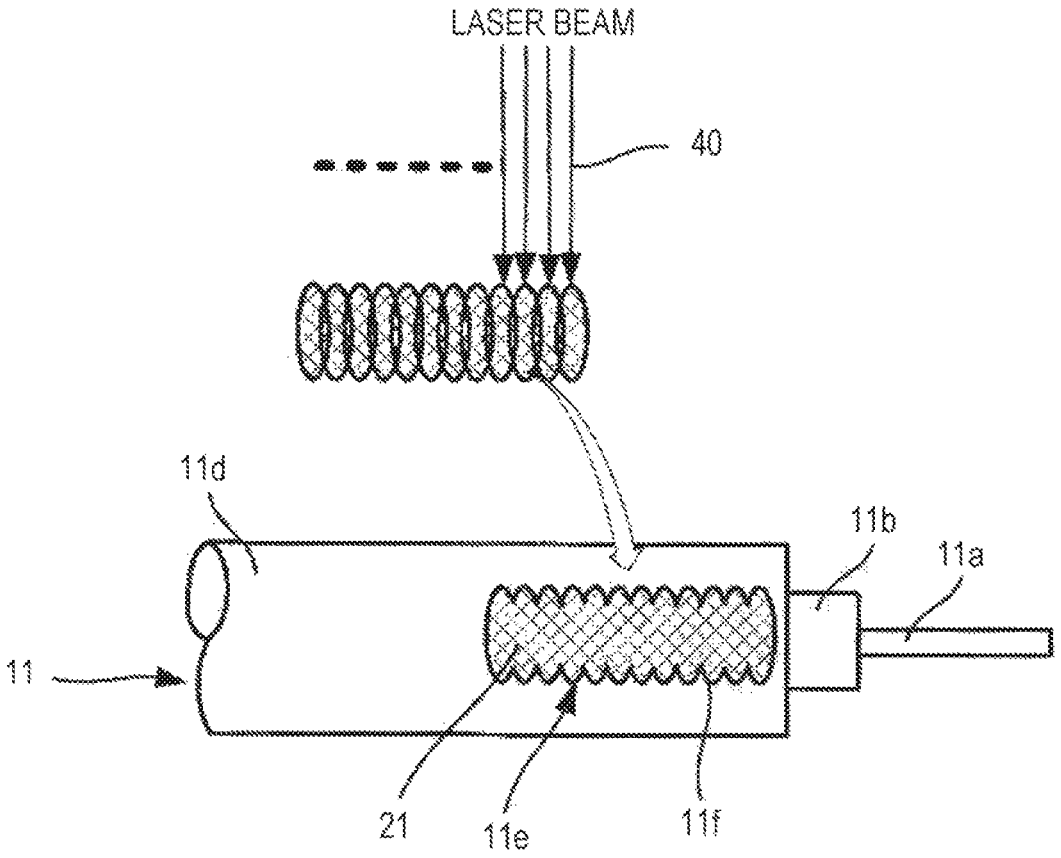
FIG. 4 is a view for describing an arrangement state of a removed portion of a coaxial cable.

As illustrated in FIG. 4, multiple recessed-raised portions 11*f* may be formed along the axial direction of the coaxial cable 11 at the removed portion 11*e*. In this case, one or both ends of the ground member 15 are adjusted to a recessed portion or a raised portion of any of the recessed-raised portions 11*f*. In this manner, even in a case where the placement position of the ground member 15 is changed due to, e.g., a design change, determination of the position of the ground member 15 in the axial direction of the coaxial cable 11 can be easily performed with high accuracy. Note that the recessed-raised portions 11*f* of the removed portion 11*e* may be simultaneously irradiated with multiple laser beams 40 such that surfaces irradiated with the laser beams 40 overlap with each other in the axial direction of the coaxial cable 11. Alternatively, the operation of irradiating the coaxial cable 11 with one or more laser beams 40 may be repeated while the coaxial cable 11 is shifted in the axial direction thereof in every irradiation.

Figure 5:
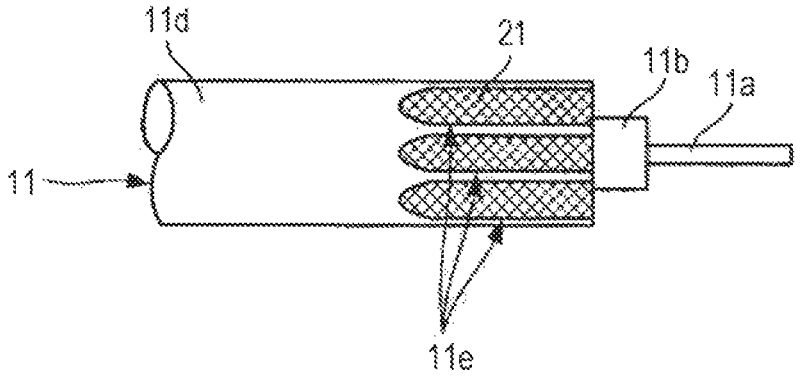
FIG. 5 is a view for describing an arrangement state of removed portions of a coaxial cable.
Figure 6:
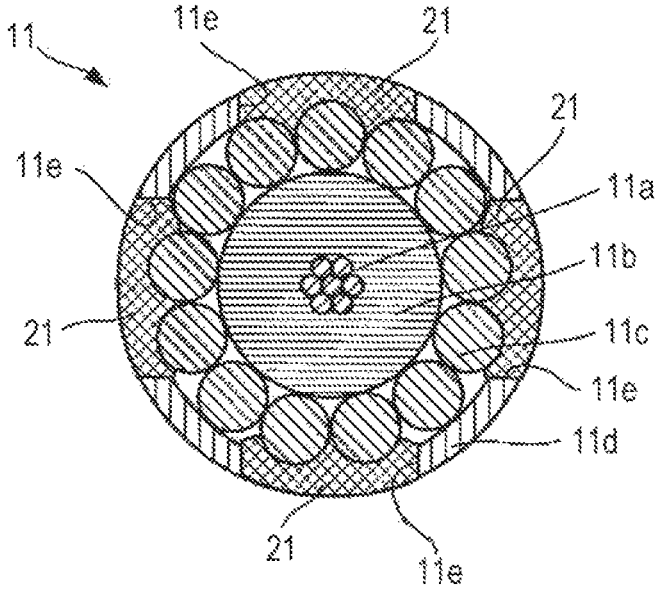
FIG. 6 is a view for describing an arrangement state of removed portions of a coaxial cable.

Alternatively, as illustrated in FIGS. 5 and 6, multiple removed portions 11*e* may be arranged in the circumferential direction of the coaxial cable 11. In this case, even when the removed portion 11*e* is shifted from a proper position in the circumferential direction due to, e.g., twist or distortion of the coaxial cable 11, the probability of causing a failure can be reduced. Note that the removed portions 11*e* may be in the same shape. Alternatively, the removed portions 11*e* may be in different shapes. Further, the removed portions 11*e* may have the same removal depth or different removal depths. Alternatively, the removed portions 11*e* in the circumferential direction may be arranged concentrated on a single spot as illustrated in FIG. 5. Alternatively, the removed portions 11*e* may be evenly arranged in the circumferential direction as illustrated in FIG. 6.

Figure 7:
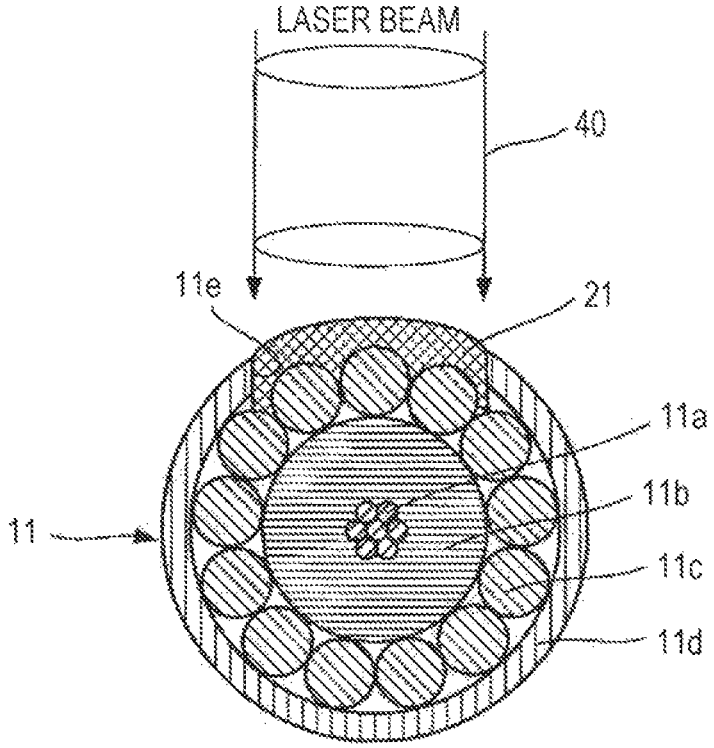
FIG. 7 is a view for describing the depth of a removed portion of a coaxial cable.
Figure 8:
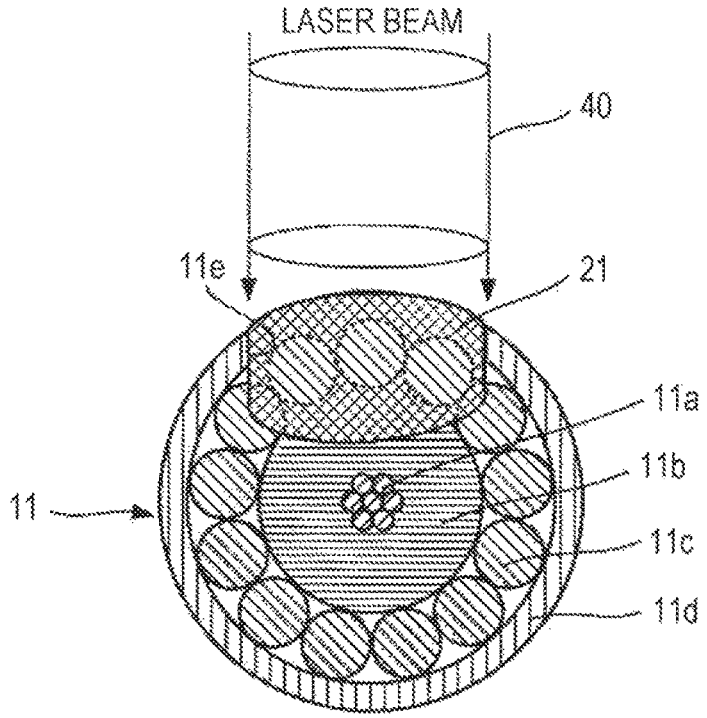
FIG. 8 is a view for describing the depth of a removed portion of a coaxial cable.
Figure 9:
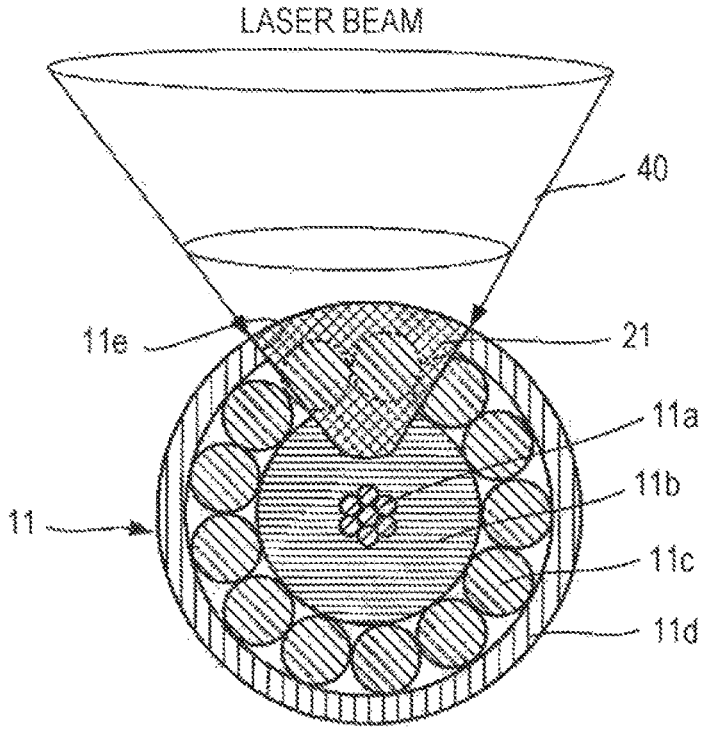
FIG. 9 is a view for describing the cross-sectional shape of a removed portion of a coaxial cable.

In the present embodiment, a case where the removal depth of the removed portion 11*e* is set to such an extent that the outer peripheral surface of the external conductor 11*c* is exposed as illustrated in FIG. 7 has been described. Note that the present embodiment is not limited to this case. Specifically, the removal depth of the removed portion 11*e* may be set such that a bottom surface of the removed portion 11*e* is in the internal insulating layer 11*b* as illustrated in FIG. 8. In this manner, the end surface of the external conductor 11*c* may be exposed. Alternatively, the removed portion 11*e* may be formed in a truncated pyramid shape having the maximum diameter on the outer peripheral side of the covering layer 11*d* as illustrated in FIG. 9. In this case, the removed portion 11*e* has an inverted truncated pyramid shape. Thus, the process of filling with the conductive member 21 is facilitated.

Figure 10:
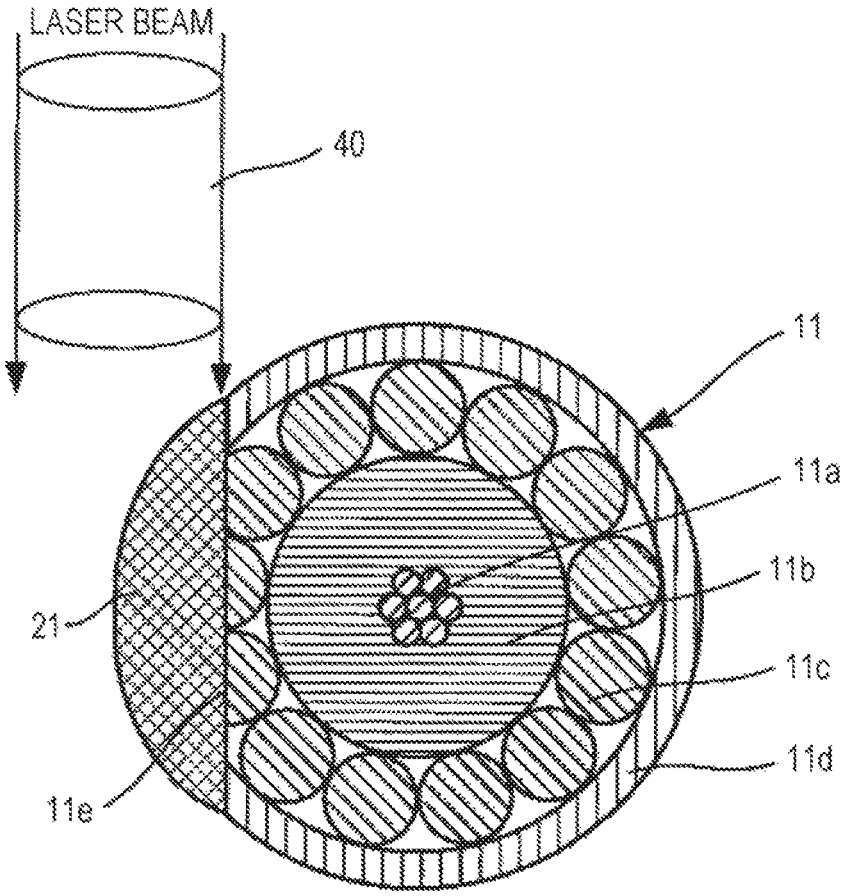
FIG. 10 is a view for describing the cross-sectional shape of a removed portion of a coaxial cable.

In the present embodiment, the removed portion 11*e* is formed in such a manner that the laser beam 40 is irradiated such that the top of the coaxial cable 11 and the center of the laser beam 40 are coincident with each other. Note that irradiation with the laser beam 40 is not limited to above. Specifically, as illustrated in FIG. 10, a region shifted from the top of the coaxial cable 11 may be irradiated with the laser beam 40. Thus, a lateral side of the coaxial cable 11 is removed. In this manner, the removed portion 11*e* may be formed. Note that FIGS. 7 to 10 illustrate a state in which the removed portion 11*e* is filled with the conductive member 21.

Figure 11:
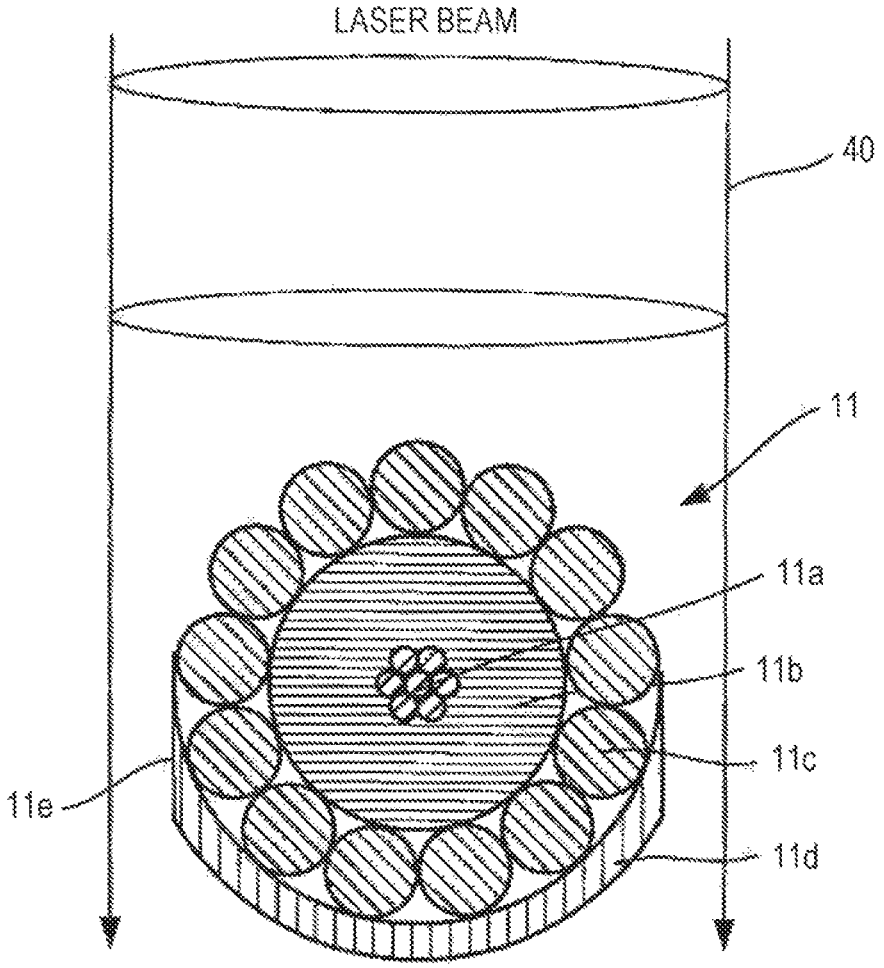
FIG. 11 is a view for describing the cross-sectional shape of a removed portion of a coaxial cable.

Alternatively, as illustrated in FIG. 11, the coaxial cable 11 may be irradiated with the laser beam 40 having a greater diameter than the width of the coaxial cable 11. In this manner, more than the half of the coaxial cable 11 in the circumferential direction may be formed as the removed portion 11*e*. Alternatively, the coaxial cable 11 may be scanned in the width direction thereof by the laser beam 40 having a smaller diameter than the width of the coaxial cable 11. In this manner, more than the half of the coaxial cable 11 in the circumferential direction may be formed as the removed portion 11*e*.

(Multicore Cable 10: Ground Coaxial Cable 12)

Figure 12:
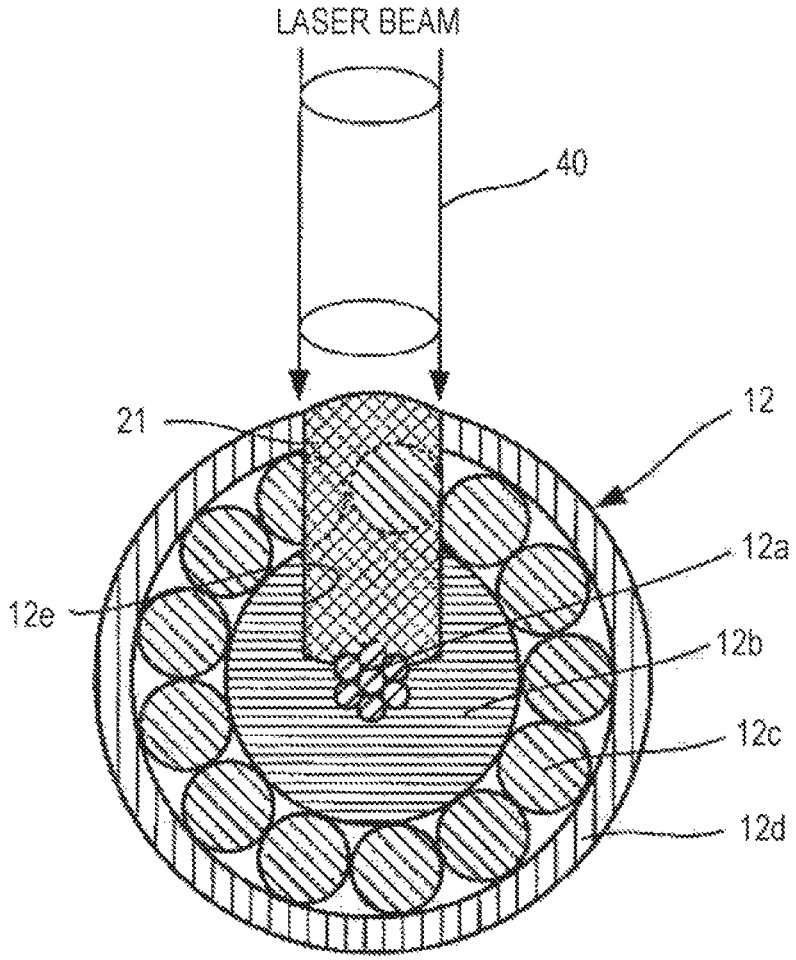
FIG. 12 is a view for describing the cross-sectional shape of a removed portion of a coaxial cable.

As illustrated in FIGS. 1 and 2, the multicore cable 10 of the present embodiment further has a ground coaxial cable 12. That is, in the multicore cable 10, at least one of the coaxial cables 11 is set as the ground coaxial cable 12. Specifically, as illustrated in FIG. 12, the ground coaxial cable 12 has an internal conductor 12*a*, an internal insulating layer 12*b* covering an outer peripheral surface of the internal conductor 12*a*, an external conductor 12*c* covering an outer peripheral surface of the internal insulating layer 12*b*, a covering layer 12*d* covering an outer peripheral surface of the external conductor 12*c*, a removed portion 12*e* formed in such a manner that part of the covering layer 12*d* in the circumferential direction is removed such that the external conductor 12*c* and the internal conductor 12*a* are exposed, and a conductive member 21 filling the removed portion 12*e*.

According to the above-described configuration, the internal conductor 12*a* and the external conductor 12*c* are exposed through the removed portion 12*e*. Thus, the internal conductor 12*a* and the external conductor 12*c* are in electric conduction with each other through the conductive member 21 filling the removed portion 12*e*. Accordingly, the multicore cable can be formed using the same coaxial cable 11 while the total of the cross-sectional area of the internal conductor 11*a* (12*a*) and the cross-sectional area of the external conductor 11*c* (12*c*) can be a current flow path cross-sectional area in at least one coaxial cable 11 (the ground coaxial cable 12). Thus, the ground coaxial cable 12 can be used as a ground short circuit cable exhibiting reduced electric resistance.

Figure 13:
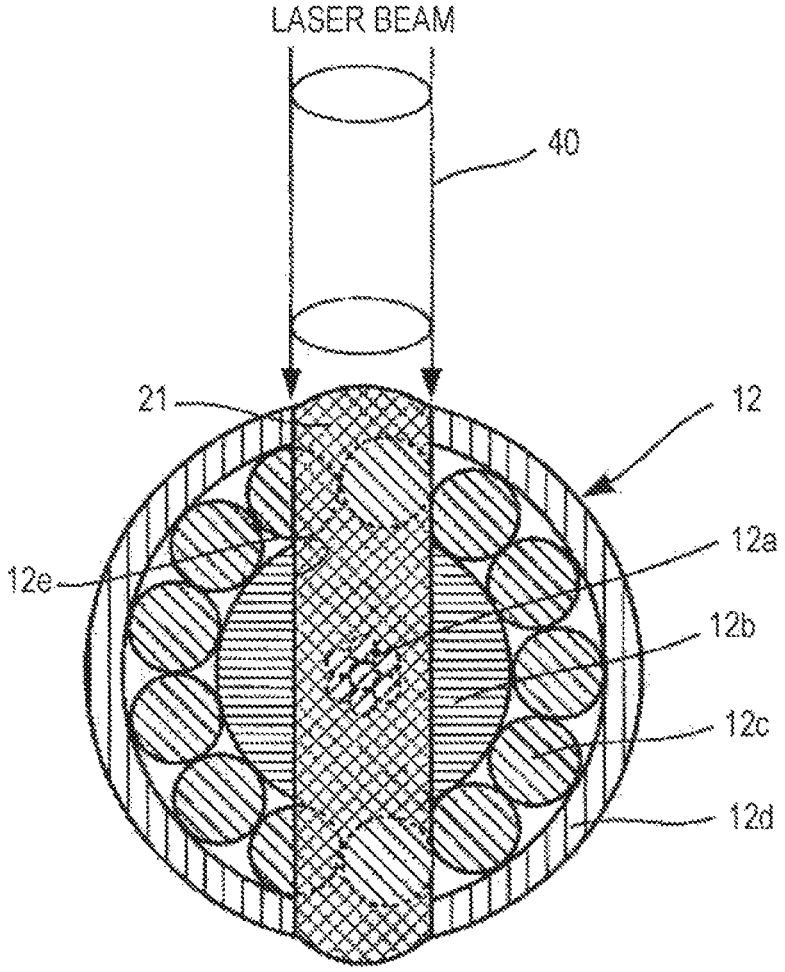
FIG. 13 is a view for describing the cross-sectional shape of a removed portion of a coaxial cable.

In the ground coaxial cable 12, the covering layer 12*d*, the external conductor 12*c*, and the internal insulating layer 12*b* are removed such that the laser beam 40 reaches the internal conductor 12*a*. Thus, the removed portion 12*e* is formed in a region from the surface of the covering layer 12*d* irradiated with the laser beam 40 to the internal conductor 12*a*. That is, the removed portion 12*e* is formed to have a depth corresponding to the radius of the ground coaxial cable 12 and to reach the internal conductor 12*a*. Note that as illustrated in FIG. 13, the laser beam 40 passing through the internal conductor 12*a* may penetrate the coaxial cable 11 in the ground coaxial cable 12. In this manner, the removed portion 12*e* having a depth corresponding to the diameter of the ground coaxial cable 12 may be formed. Alternatively, the multicore cable 10 does not necessarily include the ground coaxial cable 12. That is, the multicore cable 10 may include only the coaxial cables 11.

(Multicore Cable 10: Coaxial Cable 11: Conductive Member 21)

The conductive member 21 is formed from a member exhibiting conductivity, such as conductive paint or solder. Note that it is demanded for easily filling the removed portion 11*e* with the conductive member 21 that the conductive member 21 is in a paste state upon filling and is in a solid state upon use of the multicore cable 10. For example, the conductive member 21 includes solder thermally changeable to a molten state or a solid state.

Alternatively, the conductive member 21 may be, upon filling, conductive paste such as a conductive adhesive, conductive ink, or conductive paint in a paste form. Specifically, paste obtained by mixing of metal particles, an organic solvent, and resin can be applied as the conductive paste. Examples of the metal particle include silver and silver-coated copper powder (a spherical shape and a flake shape). Examples of the organic solvent include ethyl acetate, toluene, acetone, ethyl methyl ketone, and hexane. Examples of the resin include epoxy resin and phenol resin. In this case, the process of connecting the ground members 15, 16 with the external conductor 11*c*, i.e., filling the removed portion 11*e* with the conductive member 21 and connection of the ground members 15, 16 with the coaxial cable 11, can be completed using the conductive paste by one step. Thus, the multicore cable 10 exhibits excellent workability.

(Multicore Cable 10: Ground Members 15, 16)

As illustrated in FIG. 2, the multicore cable 10 including the coaxial cables 11 and the ground coaxial cable 12 includes the ground members 15, 16. These ground members 15, 16 are horizontally arranged such that the direction of arraying the coaxial cables 11 and the ground coaxial cable 12 is a longitudinal direction of the ground members 15, 16. Moreover, the ground members 15, 16 are arranged to sandwich the coaxial cables 11 and the ground coaxial cable 12 in the upper-to-lower direction. The ground members 15, 16 are set to have such a length that the ground members 15, 16 can contact all of the coaxial cables 11 and the ground coaxial cable 12. Further, the ground members 15, 16 are formed in a rectangular plate shape with a certain thickness. The ground members 15, 16 are formed from conductive metal plates such as copper plates. A solder layer containing coated solder is provided on one surface of the ground member 15, 16.

(Method for Manufacturing Multicore Cable)

Next, the method for manufacturing the multicore cable 10, i.e., the method for manufacturing the multicore cable 10 including the coaxial cables 11 arranged in parallel and the ground members 15, 16 conductively connected with the coaxial cables 11, will be described.

In the method for manufacturing the multicore cable 10, part of the covering layer 11*d* of each coaxial cable 11 including the internal conductor 11*a*, the internal insulating layer 11*b* covering the outer peripheral surface of the internal conductor 11*a*, the external conductor 11*c* covering the outer peripheral surface of the internal insulating layer 11*b*, and the covering layer 11*d* covering the outer peripheral surface of the external conductor 11*c* is first removed in the circumferential direction such that the external conductor 11*c* is exposed. In this manner, the removed portion 11*e* is formed. Thereafter, the removed portion 11*e* is filled with the conductive member 21. In this manner, the ground members 15, 16 are conductively connected with the conductive members 21 filling the removed portions 11*e* in a state in which the coaxial cables 11 are arranged in parallel.

According to the above-described manufacturing method, part of the covering layer 11*d* is removed, and therefore, the frequency of damaging the coaxial cable 11 upon removal of the covering layer 11*d* is more reduced as compared to the conventional case of removing the entire circumference of the covering layer 11*d*. Thus, the yield rate is improved. Consequently, cost reduction in the multicore cable 10 can be realized.

Note that the removed portion is preferably formed by the laser beam. This is because the removed portion 11*e* can be easily formed in this case.

Figure 14:
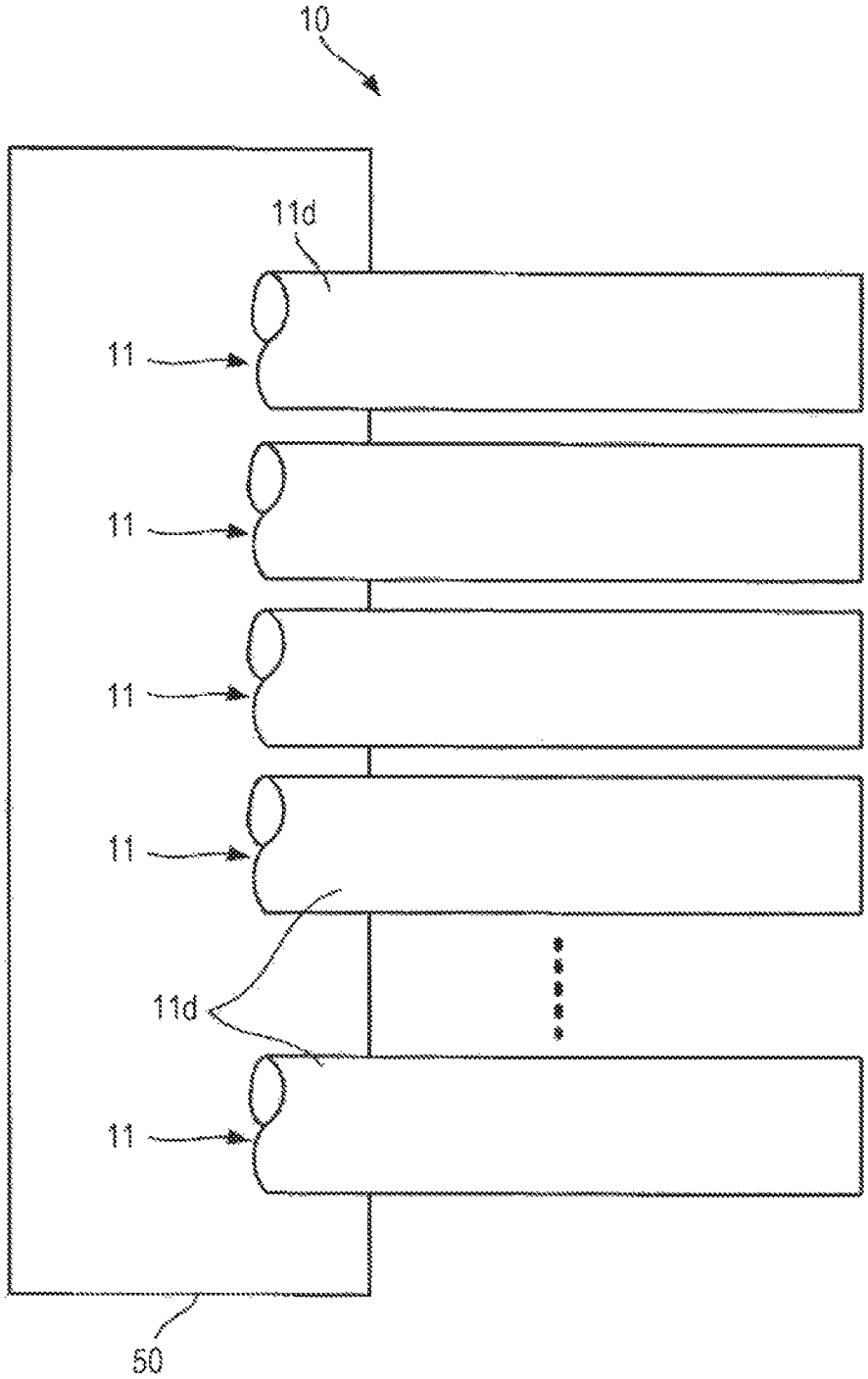
FIG. 14 is a view for describing a holding step in a multicore cable manufacturing method.

The above-described manufacturing method will be specifically described. As illustrated in FIG. 14, all of the coaxial cables 11 included in the multicore cable 10 are arranged in parallel. Then, the positions of the end portions of the coaxial cables 11 are adjusted. Then, these coaxial cables 11 are held by, e.g., a jig 50 or a tape (not shown) (a holding step).

Figure 15:
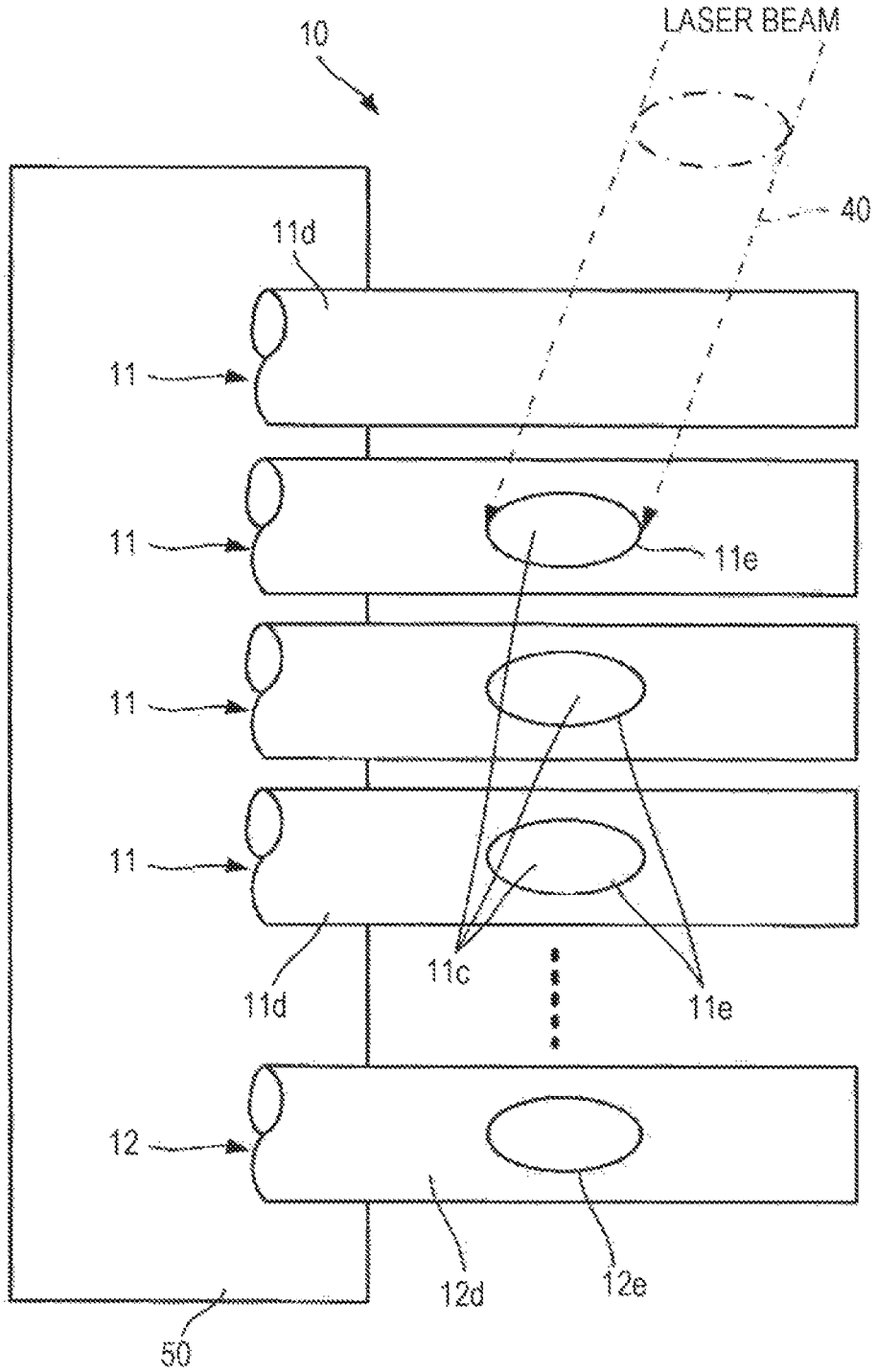
FIG. 15 is a view for describing a removed portion formation step in the multicore cable manufacturing method.
Figure 20:
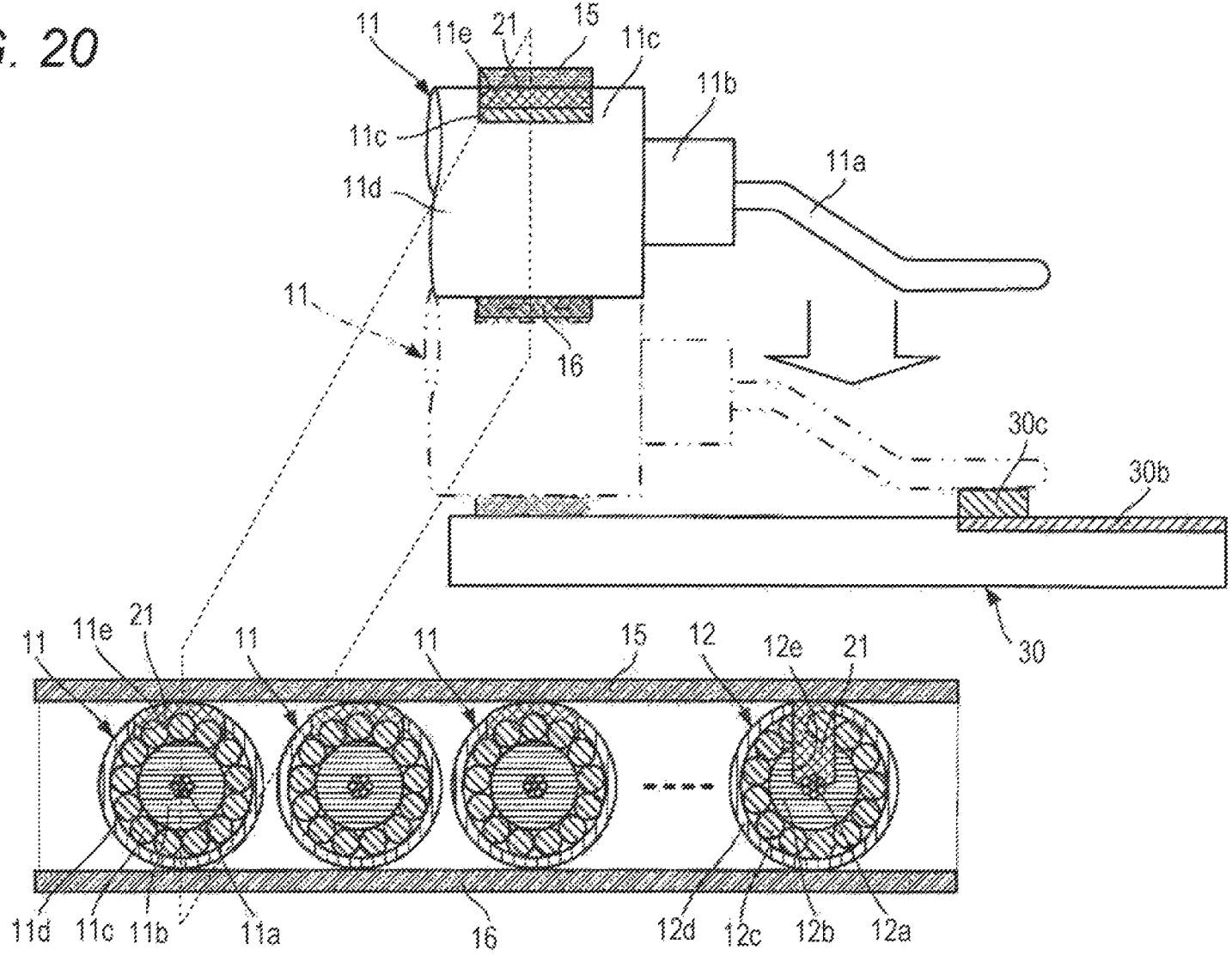
FIG. 20 is a view for describing the soldering step in the multicore cable manufacturing method.

Next, as illustrated in FIG. 15, the coaxial cables 11 are sequentially irradiated with the laser beam 40 such as an excimer laser beam. In this manner, each removed portion 11*e* is formed such that the external conductor 11*c* is exposed (a removed portion formation step). At this point, the internal insulating layer 11*b* is preferably modified polyphenylene ether resin or cycloolefin polymer resin. Note that as illustrated in FIG. 20, the external conductor 12*c* and the internal conductor 12*a* are exposed through the removed portion 12*e* obtained by the laser beam 40 reaching the internal conductor 12*a* in the coaxial cable 11 for grounding (the ground coaxial cable 12). In this manner, the coaxial cables 11 and one or more ground coaxial cables 12 are formed (the removed portion formation step).

Figure 16:
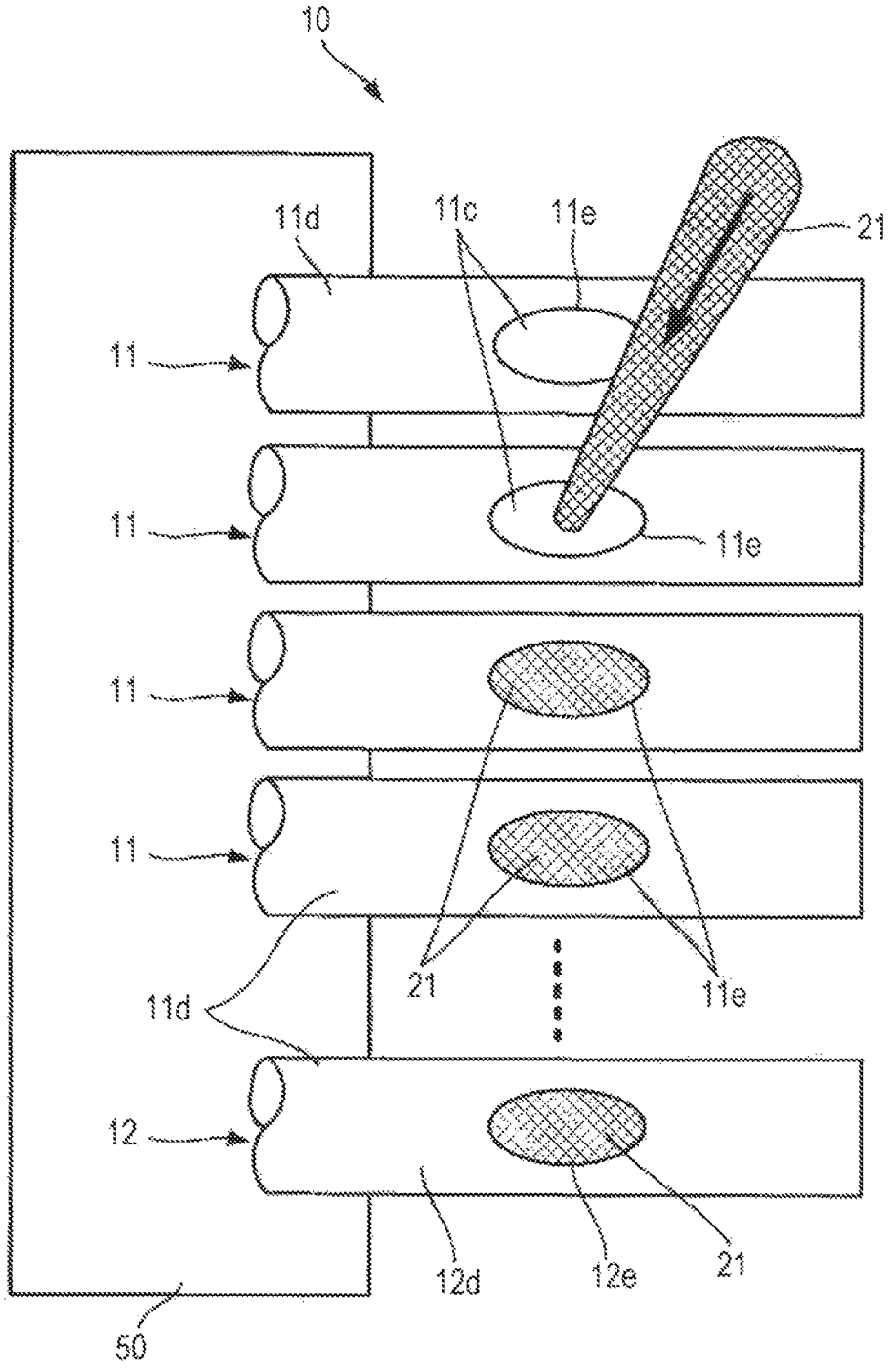
FIG. 16 is a view for describing a filling step in the multicore cable manufacturing method.
Figure 17:
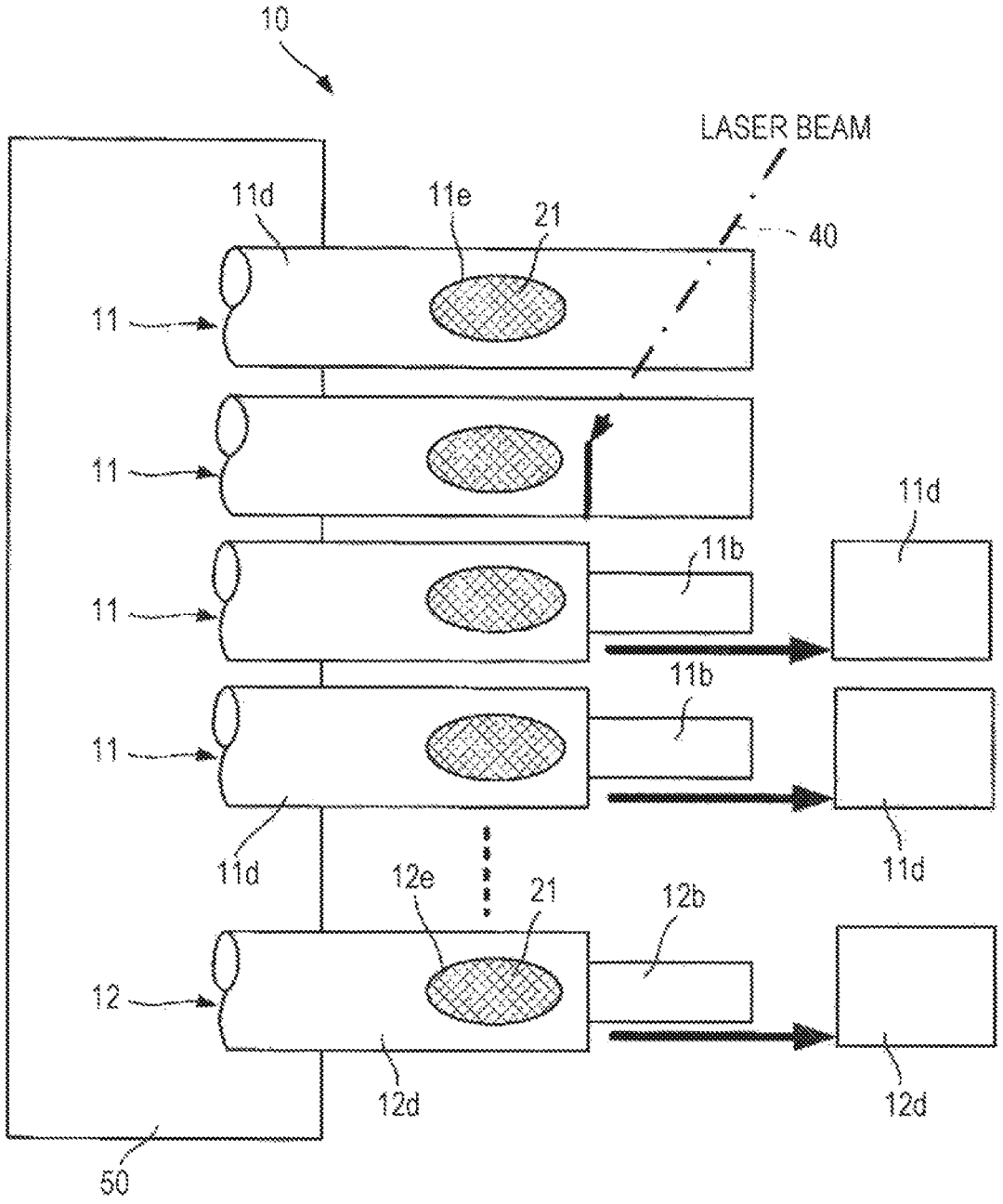
FIG. 17 is a view for describing part of a lead-out step in the multicore cable manufacturing method.
Figure 18:
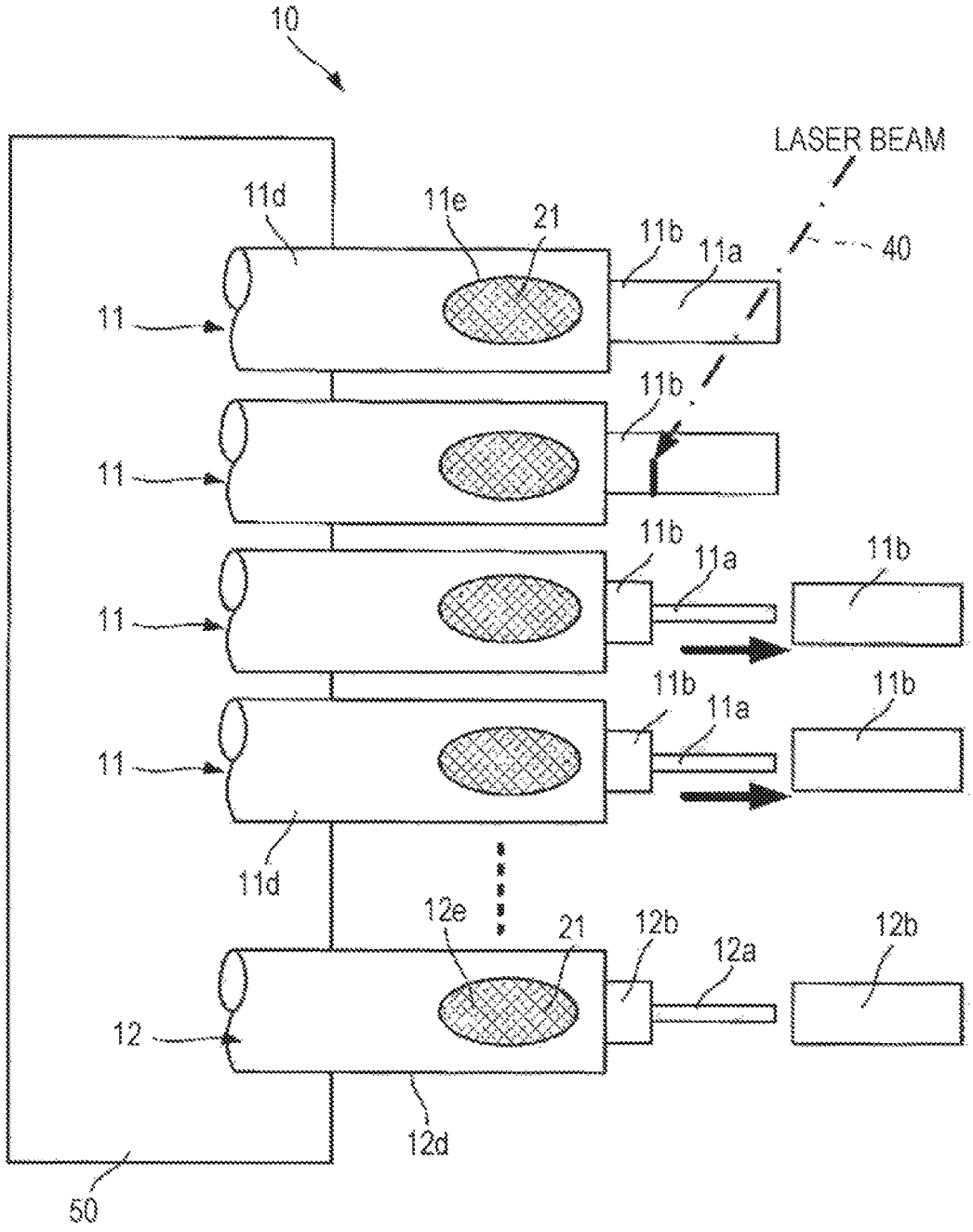
FIG. 18 is a view for describing the remaining part of the lead-out step in the multicore cable manufacturing method.

Next, as illustrated in FIG. 16, the removed portions 11*e*, 12*e* are filled with the conductive members 21. For example, the removed portions 11*e*, 12*e* are filled with the conductive paste (a filling step). Thereafter, as illustrated in FIG. 17, the wavelength and intensity of the laser beam such as a YAG laser, a CO2 laser, or an excimer laser are adjusted to cut the covering layers 11*d*, 12*d* and the external conductors 11*c*, 12*c* (see FIG. 20). In this manner, an end side is pulled and removed. Then, as illustrated in FIG. 18, the wavelength and intensity of the laser beam are adjusted to cut the internal insulating layers 11*b*, 12*b*. In this manner, the internal insulating layers 11*b*, 12*b* on the end side are pulled and removed (a lead-out step).

Figure 19:
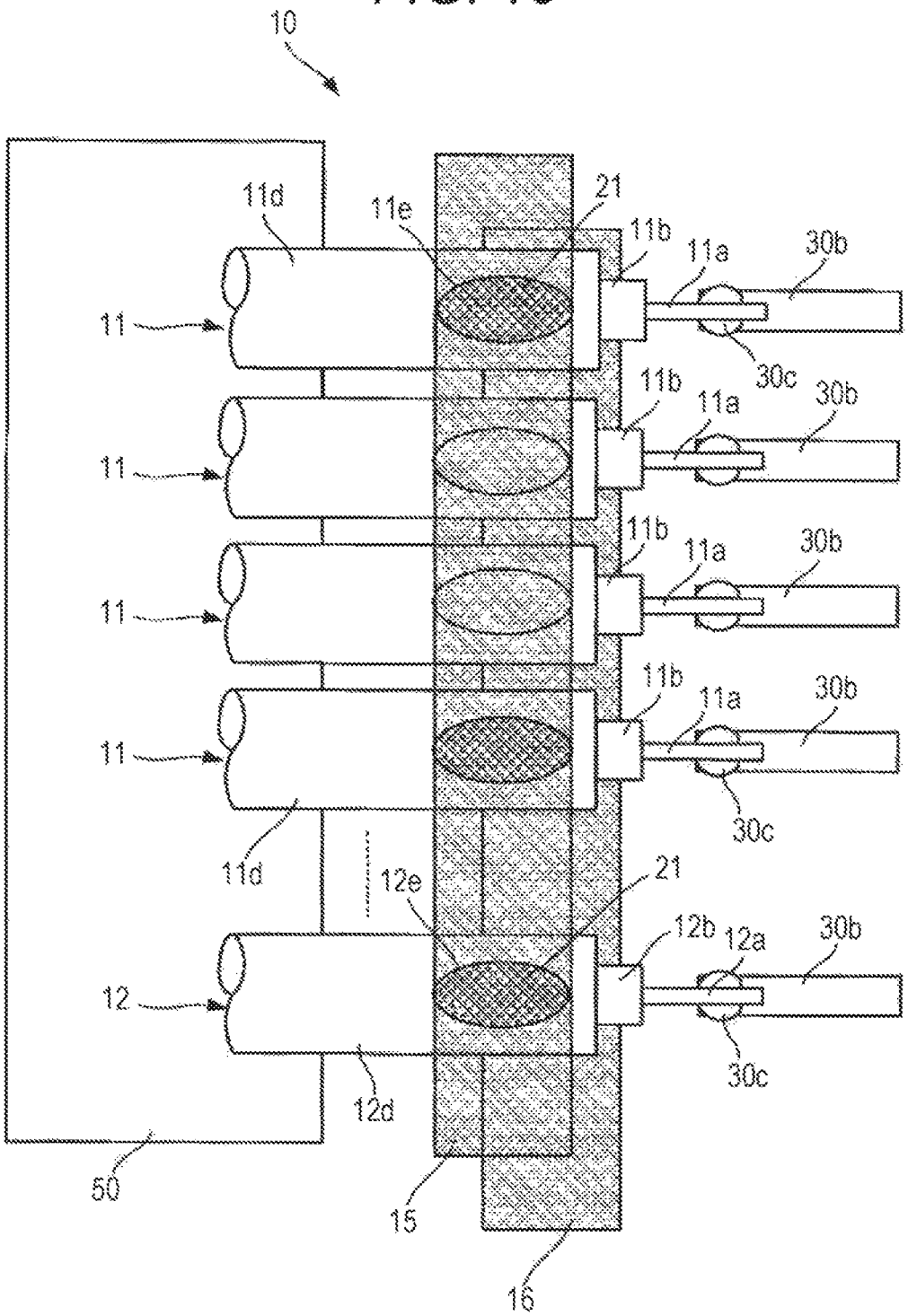
FIG. 19 is a view for describing a soldering step in the multicore cable manufacturing method.

As illustrated in FIGS. 19 and 20, the coaxial cables 11 and the ground coaxial cable 12 are sandwiched between the ground members 15, 16. The ground members 15, 16 contact the conductive members 21 filling the removed portions 11*e*, 12*e* of the coaxial cables 11 and the ground coaxial cable 12. Note that the ground members 15, 16 are set such that a solder layer side faces a coaxial cable 11 side. Then, while a sandwiching state between the ground members 15, 16 is maintained, the solder layers of the ground members 15, 16 are melted by heating. In this manner, the conductive members 21 of the coaxial cables 11 and the ground coaxial cable 12 and the ground members 15, 16 are conductively connected with each other (a soldering step).

Thereafter, the multicore cable 10 configured such that the end portions are assembled and integrated is connected to the connection target member 30 such as a connector terminal or a substrate (e.g., an FPC), as illustrated in FIG. 1. For example, in the case of connection with the connection target member 30 as the substrate, end grounding portions positioned at both end portions of the ground members 15, 16 are soldered. In this manner, the grounding portions are electrically connected with a connection target portion 30*a* for grounding. Then, the internal conductors 11*a*, 12*a* of the coaxial cables 11 and the ground coaxial cable 12 are bent as necessary, and are each soldered to the corresponding connection target portions 30*b* at the soldering portions 30*c*. In this manner, the internal conductors 11*a* and the connection target portions 30*b* are electrically connected with each other.

In a case where the connection target member 30 is the connector, the metal plate shell covering an upper side of the ground member 15 on one side is soldered. That is, the shell is connected with the connection target portion of the connector for grounding, and the ground member 15 is grounded. Moreover, both end portions of the ground members 15, 16 are electrically connected by soldering. In this manner, the multicore cable 10 is in a form as the connector-equipped multicore cable.

(Method for Manufacturing Multicore Cable: Variation)

In the present embodiment, the coaxial cables 11 and the ground coaxial cable 12 are arranged between the plate-shaped ground members 15, 16. The soldering step of conductively connecting the ground members 15, 16 and the conductive members 21 of the coaxial cables 11 and the ground coaxial cable 12 with each other in this state has been described. That is, in the present embodiment, the manufacturing method using the plate-shaped ground members 15, 16 has been described. Note that the present embodiment is not limited to this manufacturing method.

Figure 21:
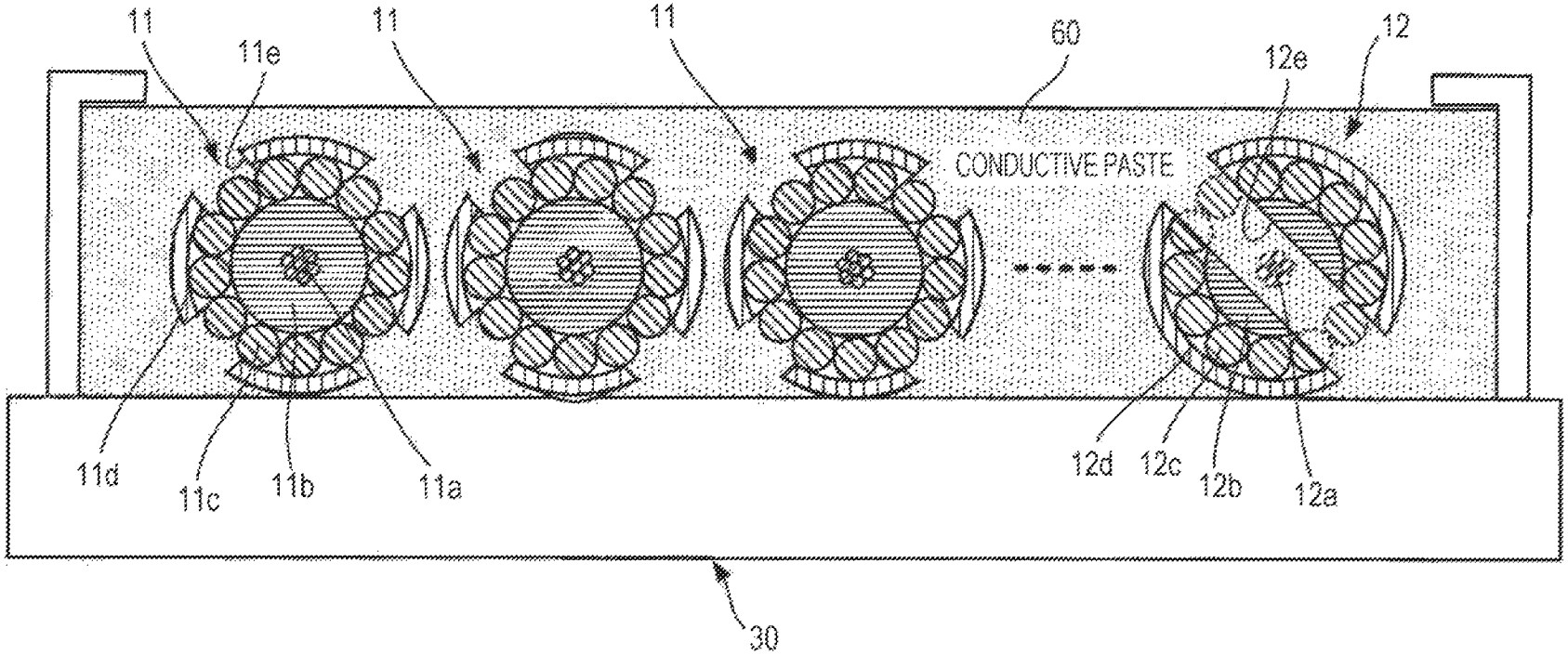
FIG. 21 is a longitudinal sectional view of a multicore cable.

Specifically, as illustrated in FIG. 21, in the method for manufacturing the multicore cable 10, part of the covering layer 11*d* of the coaxial cable 11 having the internal conductor 11*a*, the internal insulating layer 11*b* covering the outer peripheral surface of the internal conductor 11*a*, the external conductor 11*c* covering the outer peripheral surface of the internal insulating layer 11*b*, and the covering layer 11*d* covering the outer peripheral surface of the external conductor 11*c* is removed in the circumferential direction such that the external conductor 11*c* is exposed. In this manner, the removed portion 11*e* is formed. Thereafter, the removed portions 11*e* are filled with conductive paste 60 in a state in which the coaxial cables 11 are arranged in parallel. In this manner, the conductive members 21 may be formed. In addition, a ground member may be formed from the conductive paste.

According to the above-described manufacturing method, the following effect is obtained in addition to the effect in the case of using the plate-shaped ground members 15, 16. That is, the conductive paste filling the removed portions 11*e* of the coaxial cables 11 arranged in parallel forms the conductive members 21. In addition, the ground member is formed. Thus, the process of connecting the ground member to the external conductor 11*c*, i.e., filling the removed portion 11*e* with the conductive member 21 and connection of the ground member with the coaxial cable 11, can be completed using the conductive paste 60 by one step. Thus, as compared to the case of using the plate-shaped ground members 15, 16, the above-described manufacturing method exhibits excellent workability.

(Relationship between Laser Beam and Workability)

Next, study has been conducted on whether or not a difference in work quality is caused due to the material of each portion of the coaxial cable 11 or the type of laser beam in the case of forming the removed portion 11*e* at the coaxial cable 11 by the laser beam 40. Such study results will be described below.

A study method (an experimental method) will be described in detail. First, a square sheet-shaped sample piece corresponding to each portion of the coaxial cable 11 and having 100 mm (in length)×100 mm (in width) was prepared using a material of Table 1. Specifically, each sample piece corresponding to the internal insulating layer 11*b* was prepared in such a manner that each of fluorine resin, polyvinyl chloride resin (PVC), modified polyphenylene ether resin (m-PPE), cycloolefin resin (COP), a resin mixture of COP (100 per hundred rein (phr)) and styrene-butadiene copolymer (10 phr), a resin mixture of COP (100 phr) and styrene-butadiene copolymer (25 phr), and a resin mixture of COP (10 phr) and styrene-butadiene copolymer (100 phr) is formed into a square sheet shape having a thickness of 50 μm.

Sample pieces corresponding to the external conductor 11*c* were prepared in such a manner that a m-PPE square sheet (50 μm) is coated with Ag paste having a thickness of 100 μm and that copper foil having a thickness of 35 μm is formed in a square sheet shape. Each sample corresponding to the covering layer 11*d* was prepared in such a manner that each of fluorine resin, urethane resin, and polycarbonate resin is formed into a square sheet shape having a thickness of 50 μm.

Workability of each sample piece was studied when each of the above-described sample pieces was irradiated with each of a CO2 laser beam, a YAG laser beam, and an excimer laser beam. Laser beam irradiation conditions are an irradiation time of five seconds and a rectangular irradiation area of 250 μm (in length)×250 μm (in width). The same conditions are set for all of the laser beams. The workability described herein was classified into three evaluation levels including evaluation (favorable indicated by a white circle) that the irradiated laser beam penetrates the sample piece in a thickness direction, evaluation (good indicated by a white triangle) that the laser beam does not penetrate the sample piece in the thickness direction, and evaluation (poor indicated by a cross mark) that the sample piece does not react to the laser beam.

As a result, as shown in Table 1, it has been found that the excimer laser beam exhibits favorable workability (evaluation as favorable) for the m-PPE sample piece, the Ag paste sample piece, the urethane resin sample piece, and the polycarbonate resin sample piece. Moreover, it has been found that the excimer laser beam exhibits low workability (evaluation as poor) for 100% of the COP resin. However, it has been found that the excimer laser beam exhibits favorable workability (evaluation as favorable) for the sample pieces with the resin mixture of the COP and the styrene-butadiene copolymer (100:10, 100:25, 10:100).

Thus, the coaxial cable 11 was formed from the internal insulating layer 11*b* of the m-PPE or the resin mixture of the COP and the styrene-butadiene copolymer, the Ag paste external conductor 11*c*, and the covering layer 11*d* of the urethane resin or the polycarbonate resin. Consequently, it has been found that in the case of processing the coaxial cable 11 with the excimer laser beam, the removed portion 11*e* can be favorably formed.

TABLE 1

| Portion | Material | Laser Type | | |
|---|---|---|---|---|
| | | CO2 Laser | YAG Laser | Excimer Laser |
| Sample Piece corresponding to Internal Insulating layer | Fluorine Resin | ○ | x | x |
| | Polyvinyl Chloride Resin (PVC) | ○ | Δ | x |
| | Modified Polyphenylene Ether Resin (m-PPE) | ○ | ○ | ○ |
| | Cycloolefin Resin (COP) | Δ | x | x |
| | Resin Mixture of COP (100 phr) and Styrene-Butadiene Copolymer (10 phr) | Δ | x | ○ |
| | Resin Mixture of COP (100 phr) and Styrene-Butadiene Copolymer (25 phr) | Δ | x | ○ |
| | Resin Mixture of COP (10 phr) and Styrene-Butadiene Copolymer (100 phr) | Δ | x | ○ |
| Sample Piece corresponding to Shield Layer (External Conductor) | Ag Paste | x | Δ | ○ |
| | Copper Foil | x | ○ | x |
| Sample Piece corresponding to Covering Layer | Fluorine Resin | ○ | x | x |
| | Urethane Resin | ○ | x | ○ |
| | Polycarbonate Resin | ○ | x | ○ |

In the detailed description above, characteristic contents have been mainly described for the sake of more easy understanding of the present invention. However, the present invention is not limited to the embodiment described in detail above. The present invention is also applicable to other embodiments. Moreover, the scope of such application shall be interpreted as broad as possible.

Moreover, terms and phrases used in the present specification are used for accurately describing the present invention. That is, these terms and phrases are not used for limiting interpretation of the present invention. Further, those skilled in the art easily arrive at, e.g., other configurations, systems, and methods included in the concept of the present invention from the concept of the invention described in the present specification. Thus, it shall be recognized that description of the claims include equivalent configurations without departing from the technical idea of the present invention. In addition, for the sake of sufficiently understanding the object and advantageous effects of the present invention, e.g., already-disclosed documents need to be sufficiently taken into consideration.

This application claims priority from Japanese Patent Application No. 2016-069049 filed with the Japan Patent Office on Mar. 30, 2016, the entire contents of which are hereby incorporated by reference.

Specific embodiments of the present invention have been described above by way of example. These embodiments shall not be intended to be comprehensive or to limit the present invention to the described forms as they are. It is obvious to those skilled in the art that many variations and changes are available in light of the above-described contents.

LIST OF REFERENCE NUMERALS

10 multicore cable
11 coaxial cable
11*a* internal conductor
11*b* internal insulating layer
11*c* external conductor
11*d* covering layer
11*e* removed portion
12 ground coaxial cable
12*a* internal conductor
12*b* internal insulating layer
12*c* external conductor
12*d* covering layer
12*e* removed portion
15 ground member
16 ground member
21 conductive member
40 laser beam
60 conductive paste

The invention claimed is:

1. A multicore cable comprising:

multiple coaxial cables arranged in parallel; and a ground member conductively connected with the coaxial cables, wherein each coaxial cable includes an internal conductor, an internal insulating layer covering an outer peripheral surface of the internal conductor, an external conductor covering an outer peripheral surface of the internal insulating layer, a covering layer covering an outer peripheral surface of the external conductor, a removed portion formed in such a manner that part of the covering layer in a circumferential direction is removed such that the external conductor is exposed, and a conductive member filling the removed portion, and the ground member is conductively connected with the conductive member filling the removed portion.

2. The multicore cable according to claim 1, wherein the removed portion is formed in a hole shape.

3. The multicore cable according to claim 2, wherein the removed portion is formed in a truncated pyramid shape having a maximum diameter on an outer peripheral side of the covering layer.

4. The multicore cable according to claim 1, wherein in at least one of the coaxial cables, the internal conductor is further exposed through the removed portion.

5. The multicore cable according to claim 4, wherein the internal insulating layer in each coaxial cable is modified polyphenylene ether or a resin mixture of cycloolefin resin and styrene-butadiene copolymer.

6. The multicore cable according to claim1, wherein the ground member and the conductive member are formed from conductive paste.

7. A method for manufacturing a multicore cable including multiple coaxial cables arranged in parallel and a ground member conductively connected with the coaxial cables, comprising:

forming a removed portion in such a manner that part of a covering layer of each coaxial cable including an internal conductor, an internal insulating layer covering an outer peripheral surface of the internal conductor, an external conductor covering an outer peripheral surface of the internal insulating layer, and the covering layer covering an outer peripheral surface of the external conductor is removed in a circumferential direction such that the external conductor is exposed, and subsequently filling the removed portion with a conductive member; and conductively connecting the ground member with the conductive member filling the removed portion in a state in which the coaxial cables are arranged in parallel.

8. The multicore cable manufacturing method according to claim 7, wherein the removed portion is formed by a laser beam.

9. A method for manufacturing a multicore cable including multiple coaxial cables arranged in parallel and a ground member conductively connected with the coaxial cables, comprising:

forming a removed portion in such a manner that part of a covering layer of each coaxial cable including an internal conductor, an internal insulating layer covering an outer peripheral surface of the internal conductor, an external conductor covering an outer peripheral surface of the internal insulating layer, and the covering layer covering an outer peripheral surface of the external conductor is removed in a circumferential direction such that the external conductor is exposed, and subsequently filling the removed portion with conductive paste to form a conductive member in a state in which the coaxial cables are arranged in parallel while forming the ground member from the conductive paste.

* * * * *